United States Patent [19]

Bowker

[11] Patent Number: 4,678,059

[45] Date of Patent: Jul. 7, 1987

[54] ROPE DESCENDING DEVICE

[76] Inventor: Thomas K. Bowker, R.F.D. 1, Pine Acres, Rumney, N.H. 03266

[21] Appl. No.: 867,049

[22] Filed: May 27, 1986

[51] Int. Cl.[4] ..... A63B 29/00

[52] U.S. Cl. ..... 182/5; 188/65.4

[58] Field of Search ..... 182/5, 6, 7, 191; 188/65.5, 65.4, 65.2, 65.1

[56] References Cited

U.S. PATENT DOCUMENTS

| | | | |
|---|---|---|---|
| 316,870 | 4/1885 | Braunfeld | 188/65.4 |
| 3,757,901 | 9/1973 | Hobbs | 182/5 |
| 4,019,609 | 4/1977 | Wagner | 182/5 |
| 4,311,218 | 1/1982 | Steffen | 182/5 |
| 4,493,391 | 1/1985 | Van Pattern | 182/6 |

FOREIGN PATENT DOCUMENTS

| | | | |
|---|---|---|---|
| 2564736 | 11/1985 | France | 182/5 |

*Primary Examiner*—Reinaldo P. Machado

*Attorney, Agent, or Firm*—Wolf, Greenfield & Sacks

[57] ABSTRACT

A device for controlling the rate of descent of a mountain climber having an oval ring which defines an inner aperture, a rail mounted on the first surface of a size of the ring, clasping means which spans the width of the ring and means by which the device is attached to the mountain climber.

9 Claims, 15 Drawing Figures

ROPE DESCENDING DEVICE

BACKGROUND OF THE INVENTION

The invention relates to devices which control the rate of descent of any person who is supported by a rope, but in particular, to a mountain climber.

Mountain climbers commonly descend a mountain by rappelling. In this method, the climber attaches a support rope or pair of ropes to a natural feature such as a tree or rock out-crop which serve as an anchor or alternatively, to an artificial anchor implanted in the mountain. The climber then descends the mountain supported by the anchored support rope(s). The support rope is looped around or through the anchor in a manner so that two rope strands pass through a descending device which is attached to the climber's harness. After the rappel is completed, the rope may be retrieved by pulling on one of the rope strands.

The device commonly used as a rope descender is known as a Figure Eight. As shown in FIG. 1, the Figure Eight 2 consists of a pair of rings, 3, 4, integrally connected by a neck 5. The upper ring 3, through which the support rope is passed, is considerably larger in diameter than the lower ring 4 which serves as a carabiner hole to which a carabiner is attached for connection to the harness of the climber. As shown in FIG. 2, the support rope 24 is attached to the Figure Eight by passing a loop of the support rope through the large hole 6 of the upper ring 3 and then pulling it over and then under the lower ring 4 so that the rope is secured around the neck of the Figure Eight. One end of the loop 26 remains connected to the anchor whereas the free end of the rope 28 is looped around the Figure Eight and is grasped by the climber to control his rate of descent. The major factor in controlling the climber's rate of descent is the amount of friction of the rope with the descending device. In the Figure Eight, the amount of such friction is determined by the size of the rope used as this alone will determine the area of surface contact between the rope and the Figure Eight.

Use of the Figure Eight presents several problems. When the mountain climber is doing multiple rappels, the Figure Eight must be removed from the climber to reattach the rope since the free end of the rope is looped around the Figure Eight. This procedure presents a safety risk because the climber is opening his connection to the anchor to remove the Figure Eight.

Another disadvantage of the conventional Figure Eight is that the support rope occasionally slips from the neck and slides to the top of the upper ring, thereby interlocking with the length of support rope extending to the anchor, and stopping the climber's descent until the accidental locking can be undone. To avoid this problem, some Figure Eights are provided with ears which prevent such rope slippage.

A further disadvantage of the Figure Eight is that it does not work well when the support rope is frozen because of the sharp turns the rope takes while passing through the descending device during rappel.

Another disadvantage is that the Figure Eight only provides one friction level to control the rate of descent - that defined by the number and diameter of the rope(s) used, and the condition of the rope, i.e., whether the rope is wet, dry or frozen.

One attempt to overcome one of the problems of the Figure Eight by giving the climber additional control over the amount of friction is a carabiner attachment known commercially as the SMC Brake Bar manufactured by Seattle Manufacturing Company. This brake bar is pivotally attached to a side of the carabiner and may be positioned across the inner aperture of the carabiner. The support rope is looped over the brake bar to increase friction. This device has a safety problem because it loads a single carabiner at its weakest point, the pivot point of the bar. Further, the device provides only a marginal increase of friction because only one brake bar can be used.

Another method of controlling a climber's rate of descent is known as a carabiner brake which is an assembly consisting entirely of carabiners. In this method, two carabiners functioning as a brake, circumscribe the middle of two other carabiners which serve as a frame and the support rope is looped therein. A carabiner connects the carabiner frame to the climber. A major disadvantage of this method is that the lack of a solid descender body poses a safety hazard. A further disadvantage is that assembly of the carabiner brake is time-consuming and cumbersome, disadvantages which are magnified when a mountain climber is doing multiple rappels in storm conditions.

SUMMARY OF THE INVENTION

It is an object of the invention to provide a rope descending device which includes a plurality of friction levels for controlling the climber's rate of descent.

It is another object of the invention to provide a rope descending device which eliminates accidental locking of the support rope.

It is another object of the invention to prevent twisting of the support rope.

It is another object of the invention to provide a rope descending device which may be used for multiple rappels without requiring either pulling the support rope entirely through the device or detachment of the device from the climber.

It is a further object of the invention to provide a rope descending device which does not require the support rope to be bent sharply when it is attached to the device and therefore be adaptable to wet or ice ropes.

It is a still further object of the invention to provide a strengthened, yet light, rope descending device.

The present invention has an oval ring, rather than a circular ring as in the Figure Eight, for attachment to the support rope. The narrow profile of the oval section is more easily grasped with one hand than the wider Figure Eight to aid a belayer in lowering another climber when the device is used for belaying. The decreased diameter of the oval ring as compared to the circular ring of the FIG. 8 allows attaching means such as a first carabiner to be attached across the width of the ring. A pair of rails is attached on a first surface of opposing sides of the ring. These rails add significantly to the strength of the descending device. A neck connects the ring to a means for connecting the device to the climber such as a belay plate. The device is secured to the climber by a carabiner which is attached to the belay plate and the climber's harness.

The support rope connects to the device by inserting a loop of the support rope through the aperture in the ring and then inserting a clasping means such as a carabiner under the loop across the width of the ring. The rope exits the ring under the neck where it is grasped by the climber. The device can be detached from the support rope for multiple rappels by merely removing the carabiner which engages the support rope. The device therefore present a major advance in safety because it does not have gates and does not need to be detached from the climber during multiple rappels.

During descent, the level of friction of the rope with the descending device largely determines the rate of descent. Various factors affect the amount of friction desired by the climber including the dryness of the support rope, the diameter of the rope passing through the descender, the angle of the slope being descended, and the weight of the climber together with the gear being carried. Because the mountain climber may attach one, two or three carabiners across the width of either of the ring's surfaces, the device for the first time provides the climber a choice of six friction levels to control his rate of descent depending on the aforementioned conditions.

BRIEF DESCRIPTION OF THE DRAWINGS

These and other objects and advantages of the present invention will be more clearly understood from the following description with reference to the accompanying drawings in which.

DETAILED DESCRIPTION OF THE DRAWINGS

Figure 1:
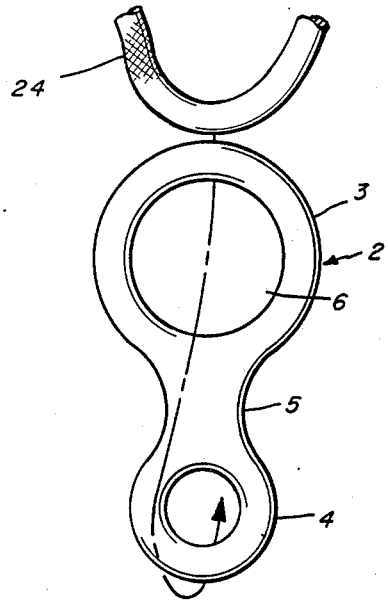
PRIOR ART Fig. 1
FIG. 1 is a top view of the prior art Figure Eight.
Figure 2:
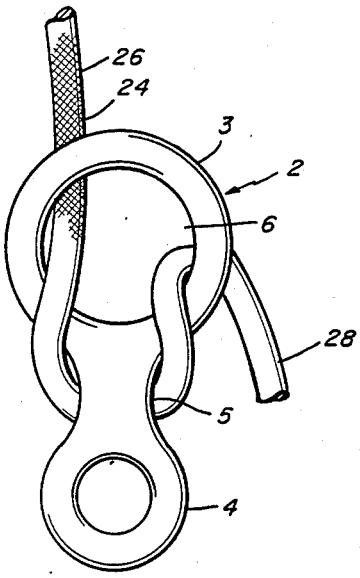
PRIOR ART Fig. 2
FIG. 2 is another drawing of the prior art Figure Eight.
Figure 3:
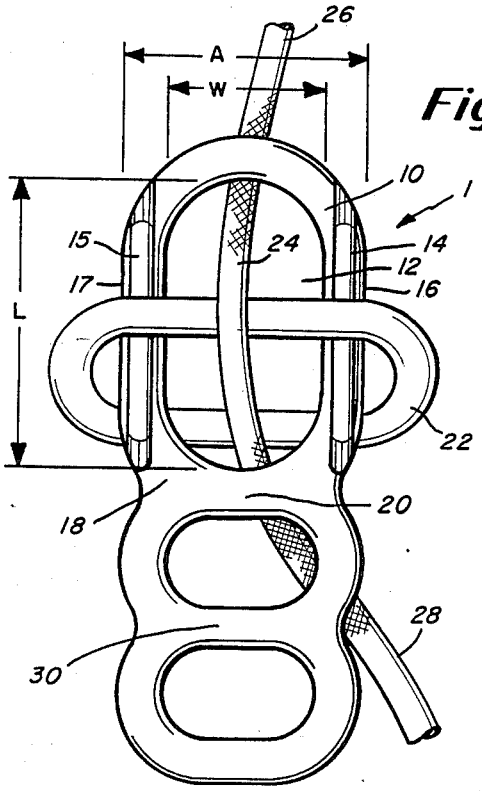
FIG. 3 is a top view of the preferred embodiment of the invention with one support rope.
Figure 14:
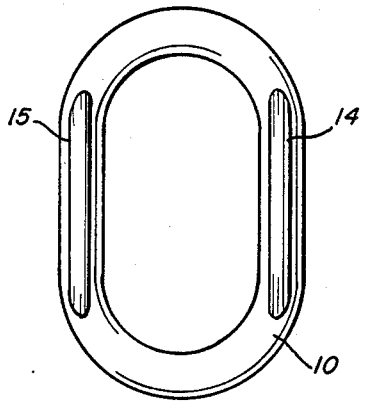
FIG. 14 is a top view of an embodiment of the invention.
Figure 15:
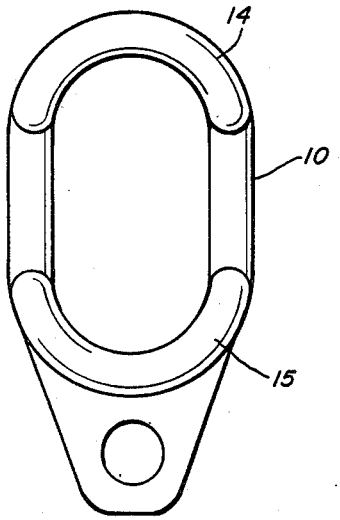
FIG. 15 is a top view of another embodiment of the invention.

The preferred embodiment of the rope descending device of the invention 1 illustrated in FIG. 3 includes a ring 10, a neck 20, and a belay plate 30. However, other embodiments of the invention do not include a belay plate as shown in FIGS. 14 and 15.

The ring 10 is oval having a width A of approximately 2 $\frac{1}{8}$ inches and defines an interior aperture 12, having a length L of between 2 inches and 3 inches and a width W of between 1 and 1 $\frac{1}{8}$ inches. Factors affecting the size of the aperture 12 include the diameter of the rope or ropes to be used and the need to restrict the size, and therefore the weight, of the attaching means which will span the aperture 12. A pair of parallel rails 14, 15 is integrally attached to opposing sides 16, 17 of a first surface 18 of the ring 10. The rails 14, 15 have a thickness of between 1/16 inch and 7/16 inches, extending the entire length of the straight section of the sides 16, 17 of the ring 10 on which the rails 14, 15 are centered.

Figure 10:
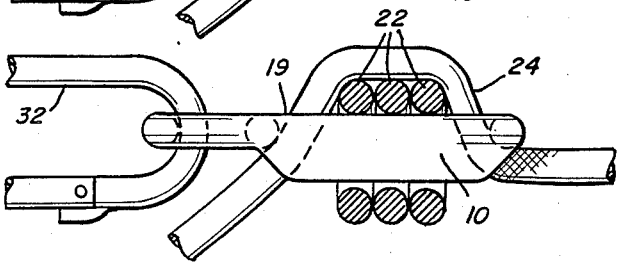
FIG. 10 is a side view of the preferred embodiment of the invention illustrated in FIG. 3 with three carabiners attached across the second side of the ring.
Figure 11:
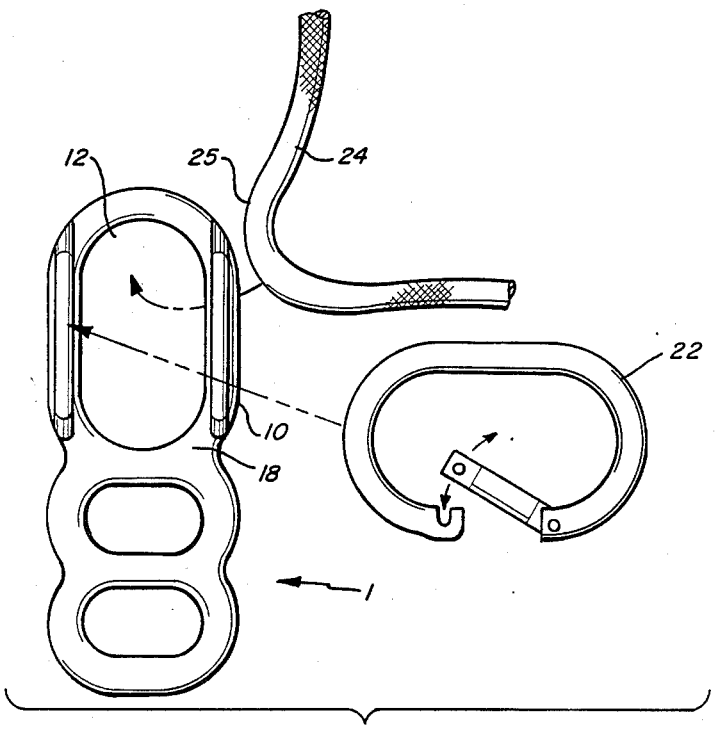
FIG. 11 is an illustration of the invention as illustrated in FIG. 3 together with a loop of support rope.

As shown in FIGS. 3 and 11 an attaching means such as a first carabiner 22 is attached to the ring 10 extending across the width of the aperture 12 with either the first 18 (see FIGS. 5, 7 and 9) or second 19 (see FIGS. 6, 8 and 10) surfaces of the ring 10 facing upwardly. The carabiner utilized is standard in size and shape. The rails 14, 15 are sized to accommodate a maximum of three carabiners.

Figure 5:
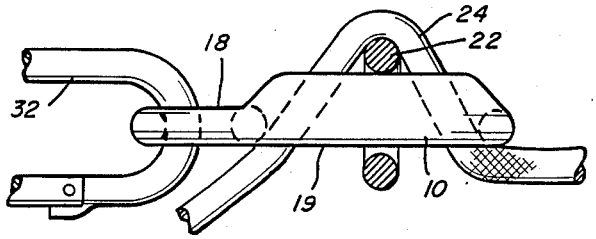
FIG. 5 is a side view of the preferred embodiment of the invention illustrated in FIG. 3 with one carabiner attached across a first side of the ring.
Figure 6:
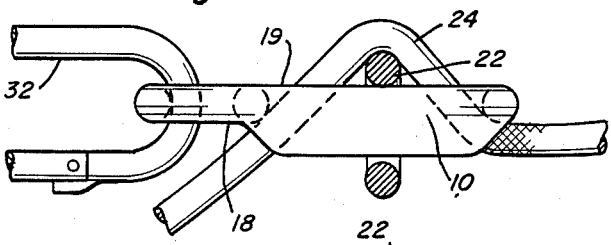
FIG. 6 is a side view of the preferred embodiment of the invention illustrated in FIG. 3 with one carabiner attached across a second side of the ring.
Figure 7:
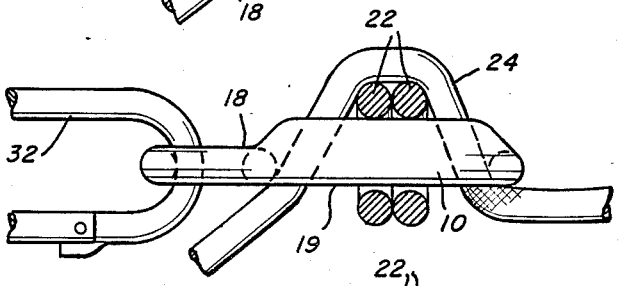
FIG. 7 is a side view of the preferred embodiment of the invention illustrated in FIG. 3 with two carabiners attached across the first side of the ring.
Figure 8:
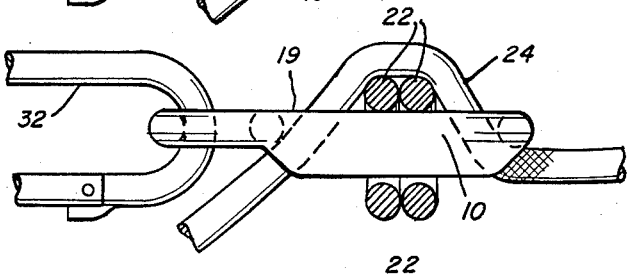
FIG. 8 is a side view of the preferred embodiment of the invention illustrated in FIG. 3 with two carabiners attached across the second side of the ring.
Figure 9:
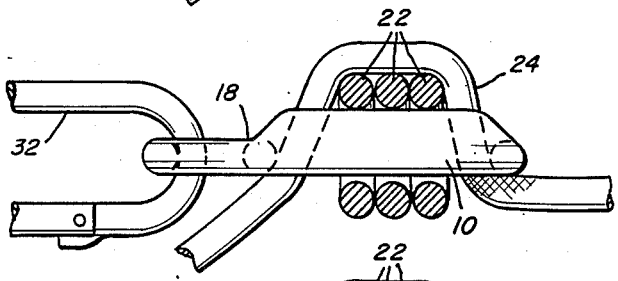
FIG. 9 is a side view of the preferred embodiment of the invention illustrated in FIG. 3 with three carabiners attached across the first side of the ring.

The first carabiner(s) 22 may be attached to the first side 18 of the ring extending across the rails 14, 15. This "slow"side attachment as shown in FIGS. 5, 7 and 9 requires the support rope 24 to have a sharper bend relative to the carabiner(s) 22 thereby increasing surface contact of the rope with the carabiner(s) with a resulting increase in friction and a corresponding slower rate of descent. Alternatively, the first carabiner(s) 22 may be attached across the second 19 or "fast" side of the ring. The support rope bends less sharply in such fast side attachment, with less contact between the support rope and the carabiner(s) as shown in FIGS. 6, 8 and 10, with a corresponding faster rate of descent due to less friction. The climber can therefore choose his desired rate of descent by attaching one, two or three carabiners across either the fast or slow sides of the ring.

Figure 4:
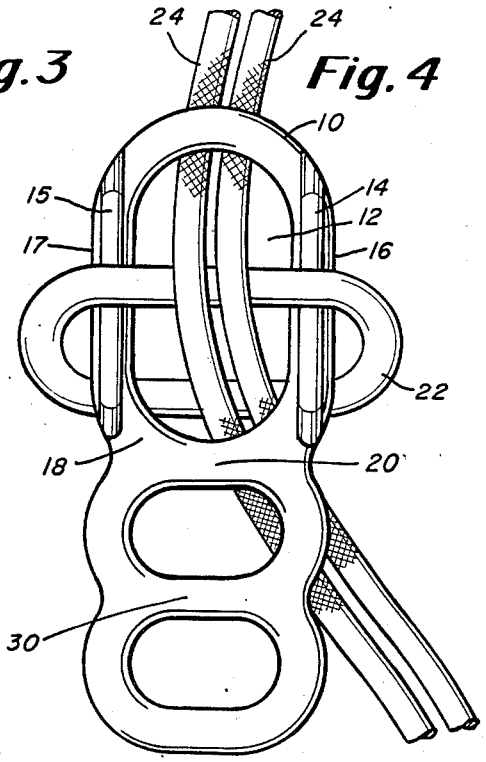
FIG. 4 is a top view of the preferred embodiment of the invention with two support ropes.

The ring 10 is integrally connected to a neck 20 which is integrally connected on its opposing end to a means for securing the device to the climber such as a belay plate 30. The belay plate 30 is conventional in size and shape and may be structured to accommodate either one or two ropes as illustrated in FIGS. 3 and 4 respectively.

The rope descending device 1 is preferably made of aluminum 6061 or 7075 heat treated to T-6 specifications but other materials having sufficient strength to support a human's weight may be used. The device, other than the clasping means, is manufactured as one unit by drop forging.

As shown in FIG. 11, the rope descending device 1 is attached to the support rope by inserting a loop 25 of support rope 24 through the aperture 12 of the ring 10. As discussed above, either the first 18 or second 19 surface of the ring 10 may be faced upwardly, depending upon the rate of descent which the climber desires. The climber then inserts one, two or three first carabiners 22 across the width A of the ring 10 underneath the loop 25 to further control his rate of descent. (See FIGS. 12 and 4–9.) As illustrated in FIG. 3, when the climber releases the loop 25, the upper strand 26 of the support rope 24 extends upwardly to the anchor (not shown) and the climber grasps the free strand 28 of the support rope 24 to control his descent. Since the support rope 24 is not secured to the outside of the ring 10, it cannot slip upwardly to accidentally interlock with the upper strand 26 of the support rope 24 as in the prior art Figure Eight. Further, the connection of the support rope 24 to the rope descending device 1 does not require the sharp turns of the prior art Figure Eight and therefore minimizes problems when the support rope 24 is frozen.

The belay plate 30 is secured to the climber's harness (not shown) by means of a second carabiner 32 (see FIGS. 5–10). If the mountain climber is to do another rappel, the rope descending device 1 does not need to be disconnected from the second carabiner 32 which is attached to the climber. Rather, the first carabiner(s) 22 which spans the ring 10 is removed and the loop of rope 25 is merely removed from the ring 10.

Figure 12:
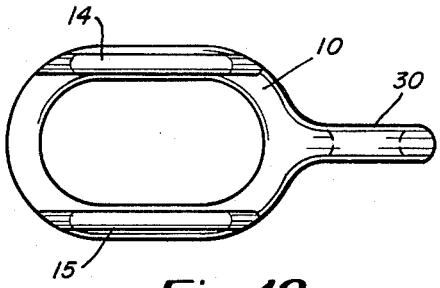
FIG. 12 is a top view of a further embodiment of the invention.
Figure 13:
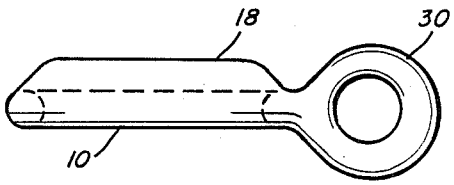
FIG. 13 is a side view of the embodiment of the invention shown in FIG. 12.

In an alternate embodiment shown in FIGS. 12 and 13, the construction is similar to the earlier described embodiment except that the belay plate 30 is rotated 90° in relation to the ring 10. The advantage of this configuration is that if the harness carabiner is horizontal, a descender with a 90° twist of the carabiner hole will prevent any lateral torque to the harness carabiner as tension is applied.

What is claimed is:

1. A rope descending device, comprising:

an oval ring defining an inner aperture, said ring having a first surface and a second surface, said surfaces lying in substantially parallel planes, a rail attached to the first surface a clasping means for attachment across the width of said ring, and means for connecting the ring to the user of the rope descending device.

2. A rope descending device according to claim 1 wherein the means for attachment comprises a first carabiner.

3. A rope descending device according to claim 1, wherein the means for connecting comprises a belay plate.

4. A rope descending device according to claim 3, wherein the belay plate is integrally attached to a neck which is integrally attached to the ring.

5. A rope descending device according to claim 3, wherein said means for connecting further comprises a second carabiner.

6. A rope descending device according to claim 1, comprising a pair of parallel rails attached to the first surface of opposing sides of said ring.

7. A rope descending device according to claim 6, wherein said first carabiner extends across said rails.

8. A rope descending device according to claim 6, wherein said first carabiner extends across the width of the second surface of said ring.

9. A rope descending device according to claim 2, comprising a plurality of said first carabiners.

* * * * *